US005813914A

United States Patent [19]

McKay et al.

[11] Patent Number: 5,813,914

[45] Date of Patent: Sep. 29, 1998

[54] GAMING MACHINE SLANT TOP CABINET

[75] Inventors: Linn A. McKay; Robert M. Dickenson, both of Las Vegas, Nev.

[73] Assignee: Casino Data Systems, Las Vegas, Nev.

[21] Appl. No.: 823,491

[22] Filed: Mar. 25, 1997

[51] Int. Cl.[6] ..... G07F 17/34

[52] U.S. Cl. ..... 463/46; 463/20; 273/143 R; 312/311; 312/328

[58] Field of Search ..... 273/143 R, 309, 273/138.2, 118 R; 463/46, 20; 312/110, 331, 311, 327, 328, 309, 312, 270.1, 266, 211, 212, 111, 108, 107

[56] References Cited

U.S. PATENT DOCUMENTS 917,725 4/1909 Faust ..... 312/110
4,440,457 4/1984 Fogelman et al. ..... 463/46
5,456,468 10/1995 Stringfellow et al. ..... 463/46
5,560,602 10/1996 Johnson et al. ..... 273/118 R

OTHER PUBLICATIONS

Slot Machines A Pictorial History of the First 100 Years by Marshall Fey, 4th Edition, Liberty Belle Books, p. 221, 1994.

*Primary Examiner*—Benjamin H. Layno
*Attorney, Agent, or Firm*—Bernhard Kreten

[57] ABSTRACT

A slant top video gaming cabinet including a top cap assembly having a display panel on a surface facing pedestrian traffic which includes means for efficient changeover. The cabinet is formed from sheet metal and allows economy in fabrication. In addition, the geometry of the cabinet promotes access only within sequestered areas by authorized personnel so that various components of the cabinet can be addressed only by appropriate personnel.

22 Claims, 9 Drawing Sheets

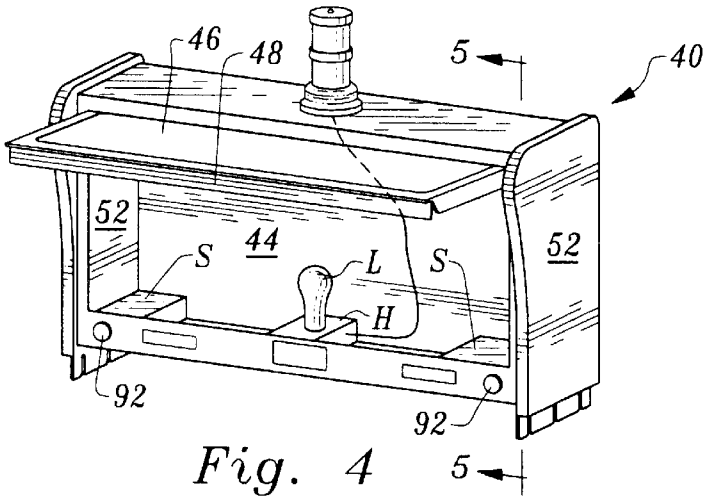
Fig. 4
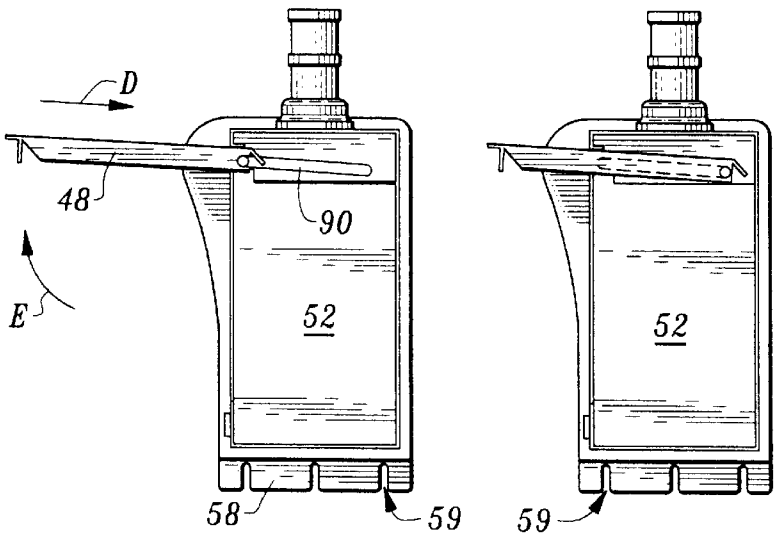
Fig. 5
Fig. 6
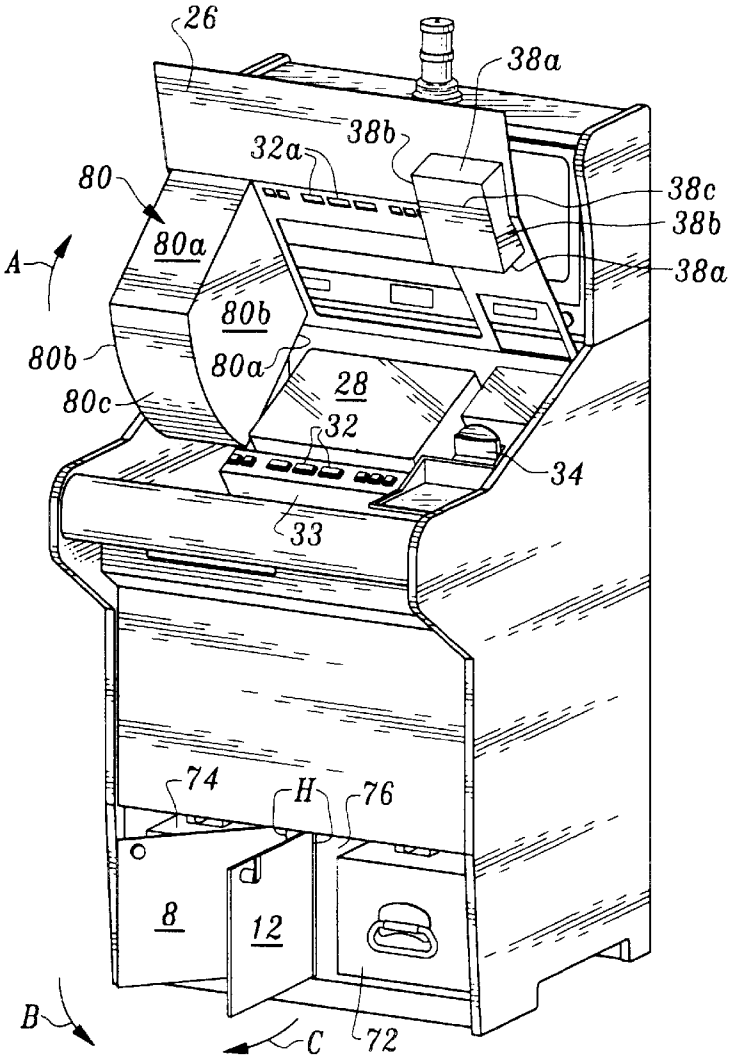
Fig. 3

Fig. 10
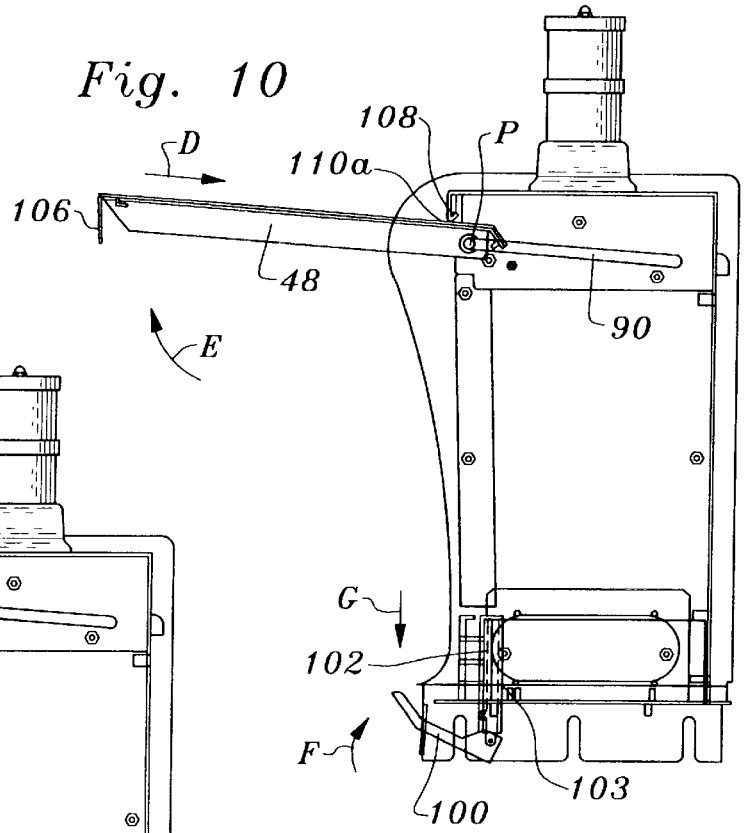
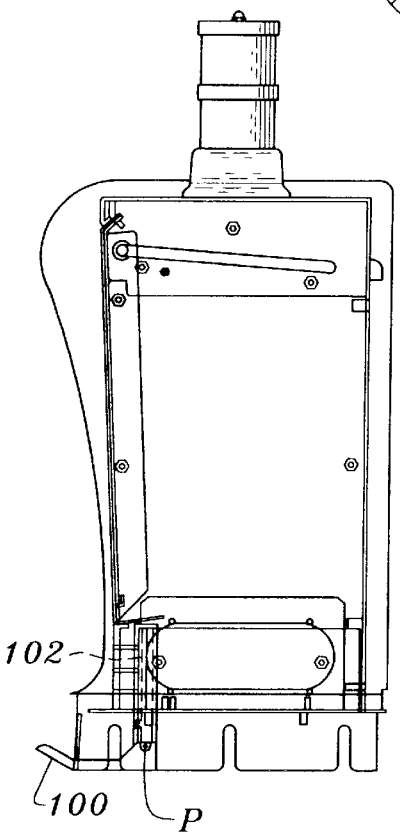
Fig. 9
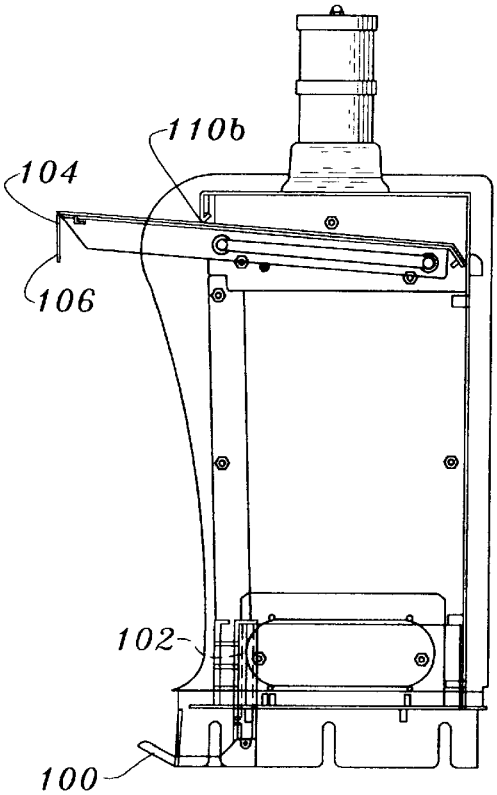
Fig. 11

GAMING MACHINE SLANT TOP CABINET

FIELD OF THE INVENTION

The following invention generally relates to a cabinet configured specifically for use with video gaming machines in a casino environment.

BACKGROUND OF THE INVENTION

Slant top video gaming cabinets typically include a wide foot print base, a cabinet extending up from the base and a player access area including a video monitor, wherein the access area is slanted such that the player is at a front edge at a lower elevation than a back edge. Slant top cabinets can also include a top cap assembly which nests with a top portion of the slant top cabinet. The top cap assembly has a display glass which extends up from the back edge of the slant top. The top cap assembly has a back wall coincident with a back wall of the slant top cabinet. This top cap assembly is a rectanguloid hollow having a beacon on a top surface thereof and the display glass on a front surface thereof is visually accessible to both passersby and the player. This top cap display glass provides visual indicia thereon which identifies the type of machine correlative with the video game device of the slant top cabinet and provides visual stimulus for passersby informing them of the nature of the game. The display glass can also provide information with respect to the pay table for the game.

Floor space at a casino is at a premium. Games which under perform compared to other games on the floor have relatively short lives. One problem that has been a constant annoyance to the gaming industry is the down time required to convert an unpopular game with a popular game. Because the video console is software driven, a new game can be reconfigured on an existing machine simply by giving software commands to a controller that drives the video monitor. A different problem arises, however, with respect to the display glass which informs the player of the game available on that machine. Presently, the mechanism by which display glass on the top cap assembly can be switched over to a different game is labor intensive. A need exists for a changeover mechanism which can change the display and pay table in a relatively modest amount of time.

In addition, the top surface of the slant top table is another area of inefficiency and cumbersome structure which has plagued the casino industry. Functionally and aesthetically, the top panel which overlies the top surface of the slant top should be well finished and utilize unobtrusive hinge structure at the juncture where the back edge of the slant top meets with the top cap assembly. The present invention addresses this need.

With respect to the cabinet design, preceding prior art cabinets are typically formed from wood products such as plywood or the like which require painting and trim detail. The cabinet according to this invention is formed from sheet metal providing a less expensive but more durable housing structure.

In addition, the cabinet structure should lend itself to manipulation and access by maintenance people and technicians in a relatively efficient manner so that the servicing of these machines can proceed expeditiously with a minimum amount of downtime. The cabinet according to the instant invention enhances these attributes.

Another area of maintenance involves the bill receiver and validator assembly. Structure associated with the instant invention overcomes inefficiencies in accessing the bill validator.

SUMMARY OF THE INVENTION

The instant invention is distinguished over the known prior art in a multiplicity of ways.

With respect to the top cap assembly, the display glass which appears on a front surface thereof is mounted in a frame having pivot points at a top most aspect thereof allowing rotation about a horizontal axis. These pivot points are constrained to move within a substantially horizontal track way parallel to a top most surface of the cap, the track way including first and second open positions. The first open position retains the display glass and frame assembly in an open upper position where the display glass projects forwardly towards the front edge nearest the player to allow access into the interior and more particularly to allow removal to the display glass for change over. The track way also allows the frame and display glass to slide along the track way within the interior of the display cap and to be held securely therein also allowing access to the interior of the cap and defining a second open position. This allows greater access to the electronics contained within the cap. Because the display glass is rotated from a substantially vertical plane (closed position) to a horizontal one, and prior to slideable nesting insertion within the cap housing along the track way, access to the display glass affords rapid turnover from one display glass to the next.

With respect to the slant top cabinet's top surface, the panel which rests thereover includes a piano type hinge which is invisible from external access for security and aesthetics. The hinge is disposed along a back edge of the panel adjacent the top cap assembly running parallel to the front edge of the machine and allows the slant top panel to be pivoted from a first closed position to a second open position. This allows access to interior components of the machine such as the video monitor should maintenance be required. In addition, the panel includes a circumscribing well located around the bill acceptor validator to sequester the contents thereof from all but authorized personnel. The top surface of the panel includes a latched door frame over the bill validator mechanism which allows only authorized personnel access to the bill validator receiver.

The lower front face of the slant top includes two access doors. One door sequesters electronics for authorized personnel. A second door sequesters a coin drop so that the various technicians and personnel who have authorization for limited access are precluded from an area outside their scope of responsibility.

By having the cabinet formed from sheet metal, a durable outer skin has been provided which entails substantially less cost of materials and labor during assembly and promulgates security.

OBJECTS OF THE INVENTION

Accordingly, a primary object of the present invention to provide a new and novel slant top cabinet for video gaming machines.

A further object of the present invention is to provide a device as characterized above which lends itself to mass production techniques and provides security with respect to areas that are to be sequestered from personnel having different job descriptions.

A further object of the present invention is to provide a device as characterized above which makes unauthorized access to various areas of the cabinet less likely and more difficult.

A further object of the present invention is to provide a device as characterized above which maintains and enhances the aesthetics while simultaneously reducing costs of labor and material for fabrication.

A further object of the present invention is to provide a device as characterized above in which the display mechanism can be accessed efficiently for rapid changeover.

A further object of the present invention is to provide a device as characterize above which minimizes routine servicing.

Viewed from a first vantage point, a gaming cabinet is provided comprising, in combination: a base, a housing extending up from the base, a top panel overlying the housing, a cap extending up from the housing rearward of the top panel, the cap having a substantially rectangular hollow contour and including a front display panel adjacent the top panel, the display panel including a circumscribing frame including pivot pins at top lateral extremities, the pins captured in a trackway to move the display panel from a display position to a retracted position in the cap.

Viewed from a second vantage point, a gaming cabinet is provided comprising, in combination: a base, a housing extending up from the base, a top panel overlying the housing, the top panel having a hinge at an edge remote from a front wall thereof, the hinge concealed from plain view.

Viewed from a third vantage point, a gaming cabinet is provided comprising, in combination: a base, a sheet metal housing extending up from the base, a top panel overlying the housing, a front wall of the housing including plural locked portals which, when opened respectively reveal only either a coin drop box or game electronics hardware.

These and other objects will be made manifest when considering the following detailed application when taken in conjunction with the appended drawing figures.

BRIEF DESCRIPTION OF THE DRAWINGS

FIG. 3 is an elevational perspective view of the gaming machine showing a slant top upper panel and the pair of bottom doors in an opened position.

FIG. 4 is an elevational perspective view of the top assembly with its display glass open.

FIG. 5 is a sectional view along lines 5—5 of FIG. 4.

FIG. 6 is a view similar to FIG. 5 showing the display glass stored.

FIG. 9 is a detailed side view of the top cap assembly showing the front display glass in a closed latched position.

FIG. 10 is a detailed plan side view of the top cap assembly showing the front display glass rotated from a closed position to an open position.

FIG. 11 is a detailed plan side view of the top cap assembly showing the front display glass in an opened, unlatched and supported position.

DESCRIPTION OF THE PREFERRED EMBODIMENT

Figure 2:
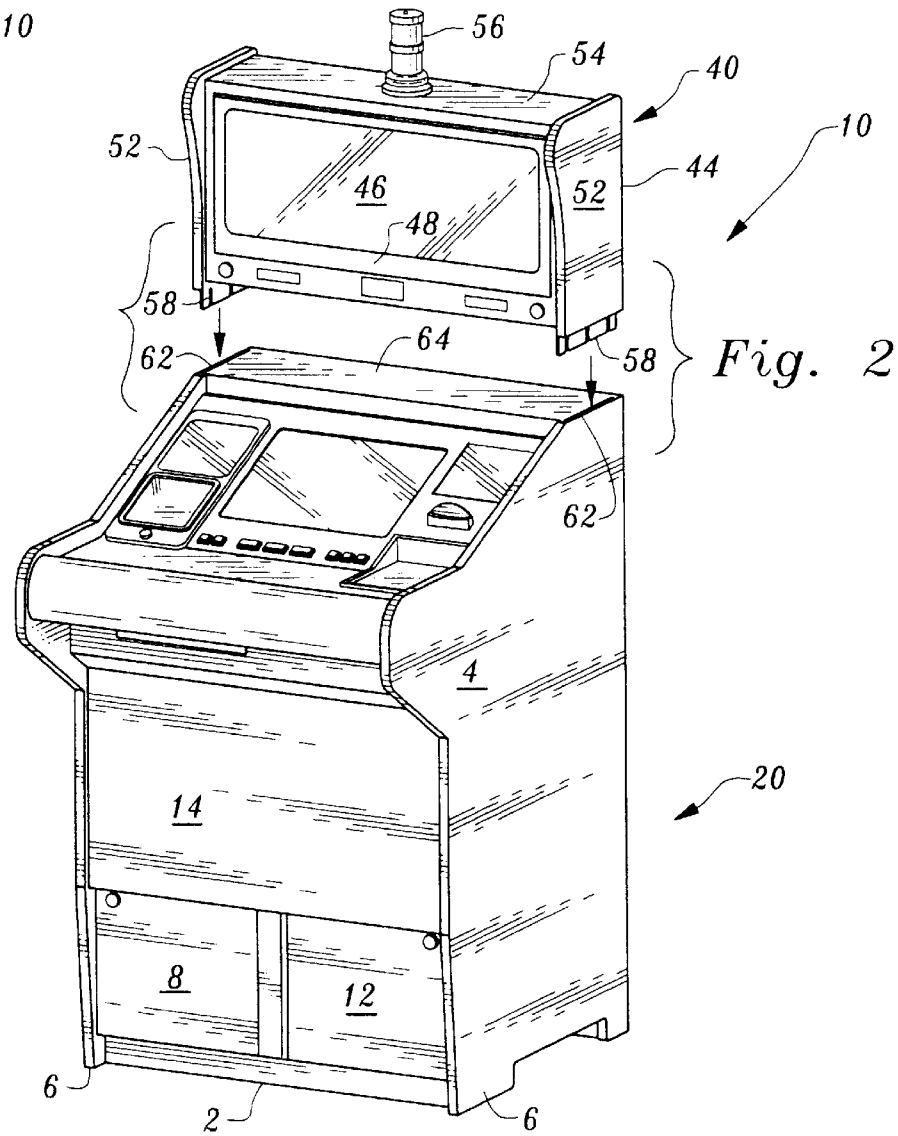
FIG. 2 is an elevational perspective view of a gaming device showing a top cap assembly removed therefrom.
Figure 1:
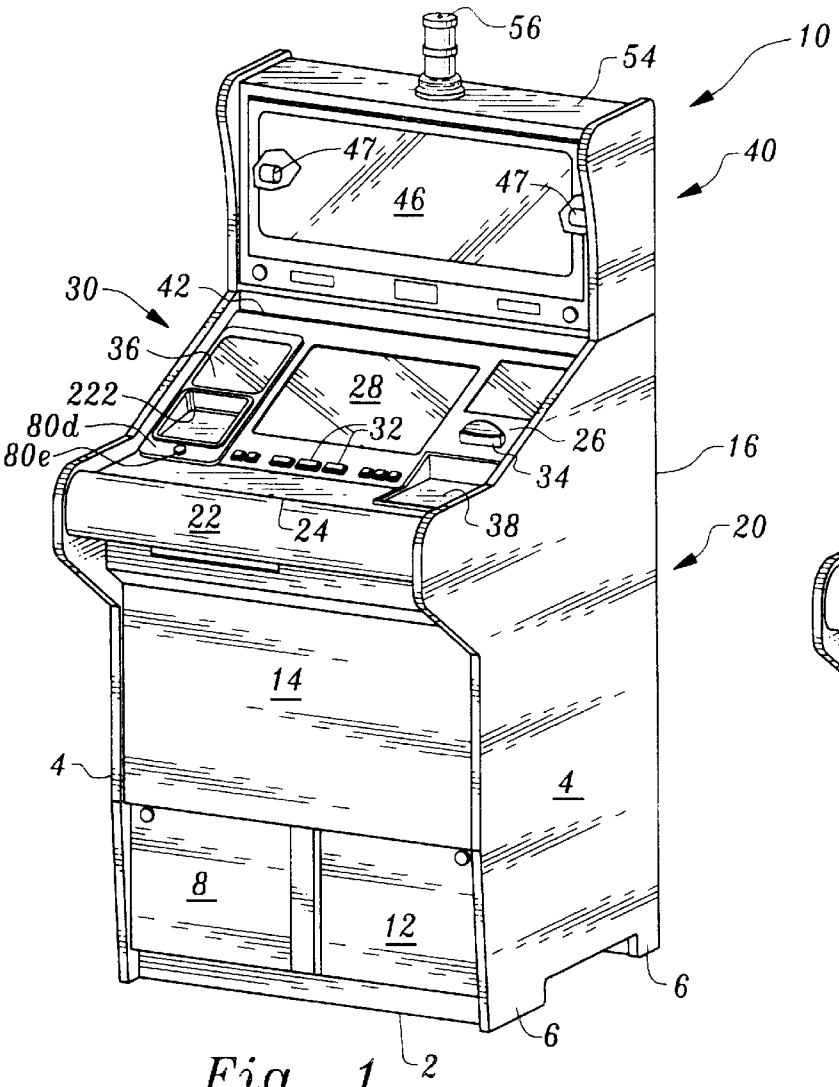
FIG. 1 is an elevational perspective view of a slant top gaming device according to one form of the present invention.

Referring to the drawings, wherein like reference numerals denote like parts throughout, reference numeral 10 is directed to the gaming machine slant top cabinet according to the present invention, particularly as shown in FIG. 1.

In its essence, the slant top cabinet 10 includes a cabinet housing 20, a player access area 30 and a top cap 40.

More specifically, the cabinet housing 20 includes a base 2, a pair of spaced parallel side panels 4 supported on four feet 6, a front panel formed with two lower doors 8, 12, an openable upper panel 14 and a back panel 16. The cabinet transitions at an upper portion to a player access area 30.

The player access area 30 includes a front cushion 22 immediately adjacent a front edge 24 of a panel 26 shown open in FIG. 3 and closed in FIG. 1. The panel 26 circumscribes a video monitor 28, a plurality of decision making buttons 32 supported on a box 33 including devices reactive to the buttons 32, a coin slot 34, a bill receiving area 36 and a coin bowl 38. A back edge 42 of the slant top panel 26 includes a hinge to be described.

The top cap assembly 40 includes a back wall 44, a front display glass 46 ensconced in a frame 48 circumscribing the display glass 46, a pair of side walls 52 and a top wall 54. The top cap 40 may include a beacon 56 on its top wall 54 thereof. Lower extremities of the side walls 52 include projections 58 that can be received within slots 62 formed along a juncture between the side panels 4 and a top surface 64 of the cabinet housing 20.

FIG. 3 reflects the panel 26 being moved from the FIG. 1 position to an open position about arrow A and similarly includes door 8 being moved along arrow B and door 12 being moved along arrow C about hinges H. Door 12 provides limited access to a coin box 72 while door 8 provides limited access to electronics 74. There is a partition 76 between the two compartments accessible by doors 8 and 12, the partition 76 assures limited access to the coin box and electronics 74 so that only personnel authorized for access in either of those areas will be exposed to the area associated with their given responsibility.

Similarly, opening the slant top panel 26 along the direction of arrow A allows technicians access to the monitor 28 and the decision making buttons 32 and its box 33, but not the interior of the bill receiver 36 since the bill receiver is disposed within a circumscribing well 80 such that the bill receiver is sealed off from anyone having access below the slant top panel 26 who can open panel 26 about the arrow A as set forth above. The well 80 includes first and second opposite ends 80*a*, sides 80*b* and a bottom 80*c* with an access frame 80*d* on top of the panel 26 and includes a latch 80*e*.

As shown in FIGS. 1 and 3, the coin bowl 38 includes a bottom wall 38*c*, side walls 38*b*, a front wall and rear wall 38*a* and is open on its top shown by reference numeral 38 of FIG. 1.

Holes 32*a* on panel 26 allow the decision making buttons 32 to project therethrough. The monitor 28 and buttons are exposed when the panel is open. Both the monitor 28 and decision making button box 33 can be readily removed as modules.

Referring to FIGS. 4 through 6, a general understanding of the manner in which the display glass 46 can move from the closed position of FIG. 1 to the open position of FIG. 6 can be appreciated. In essence, the display glass 46 is constrained by rotating retaining clips 47 within a circumscribing frame 48. The display glass and frame assembly are adapted to fit flush within the top cap assembly 40. The display glass 46 and frame 48 can move horizontally in the direction of arrow D (FIG. 5) within a trackway 90 to allow the display glass 46 and frame 48 to be unobtrusively telescoped therewith in should the interior contents of the top cap assembly 40 require maintenance.

In addition, sound can emanate via speaker holes 92 located on a circumscribing marginal portion of the cap 40 below the lowermost portion of the frame 48, and associated hardware H for backlighting L enabling the beacon 56 and the means to enable the speakers S can be contained within the interior of the top cap assembly 40.

Figure 7:
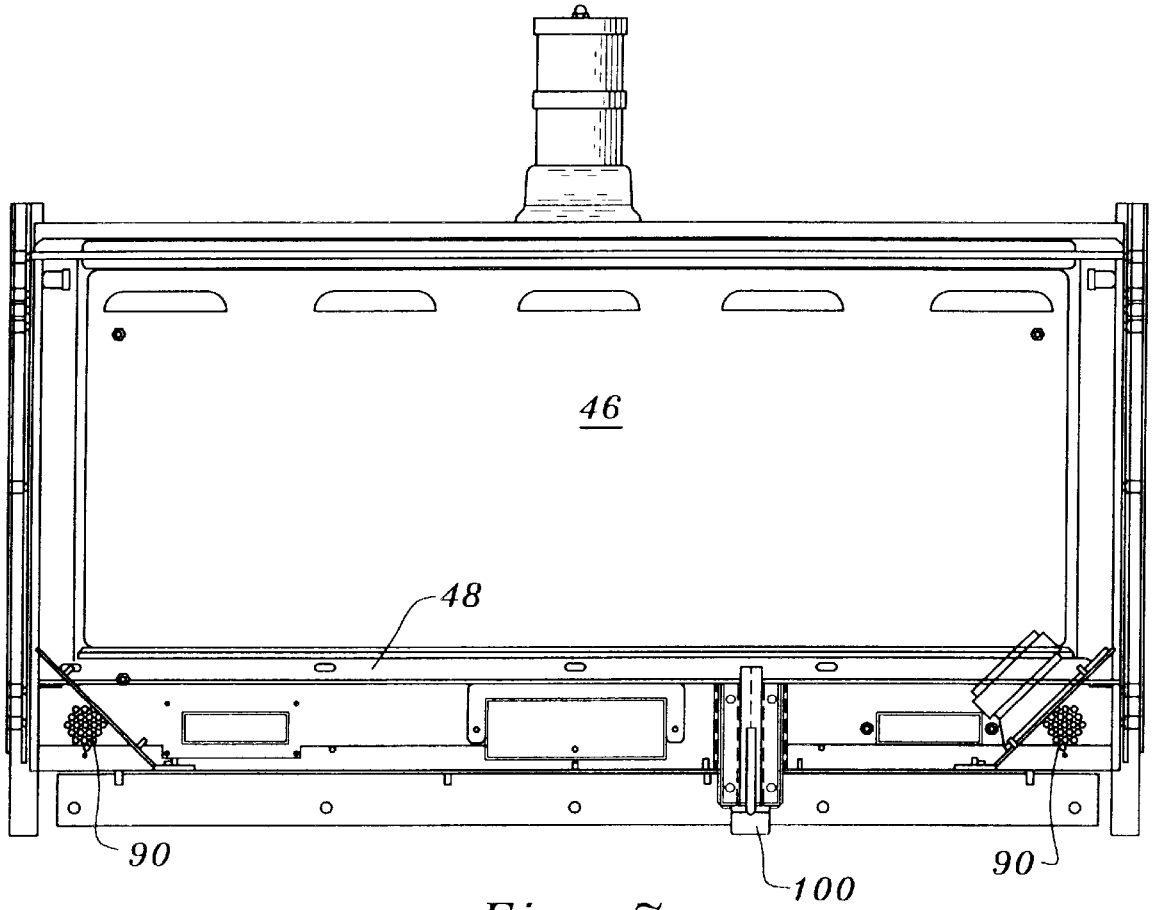
FIG. 7 is a front plan view of the top cap assembly shown in FIG. 2.
Figure 8:
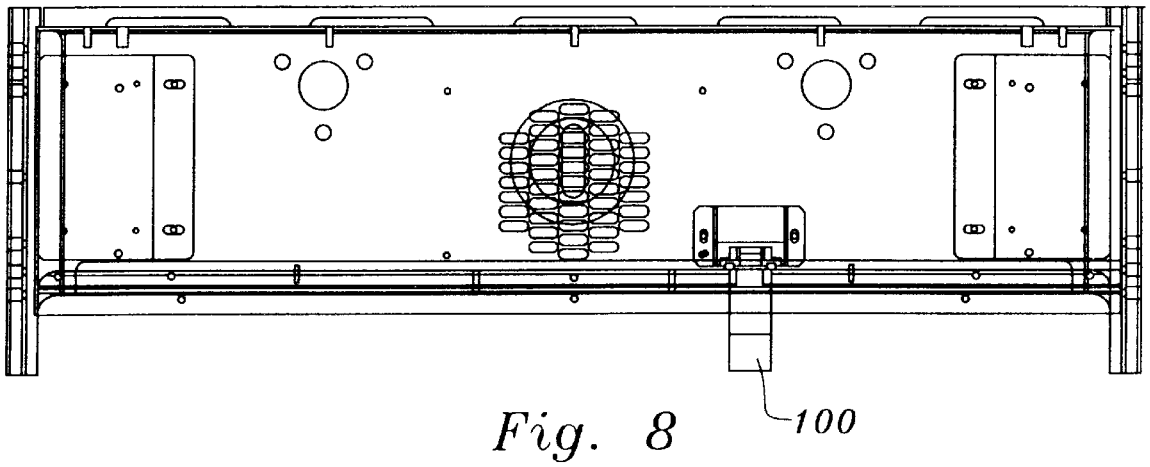
FIG. 8 is a bottom plan view of the top cap assembly shown in FIG. 4.

FIGS. 7 and FIG. 8 reflect a front view and bottom view respectively of a latch 100 that allows the display glass 46 and circumscribing frame 48 to move first along arrow E of FIG. 5. To remove the display glass 46 from frame 48, a retaining device, such as clips 47 (FIG. 1) are rotated to provide clearance to remove display glass 46 from frame 48. Subsequently, the display glass 46 and frame 48 move along arrow D to achieve the stored position of FIG. 6.

More particularly, and with respect to FIGS. 9 through 11, the latch 100 moves about the direction of arrow F (FIG. 10) and this allows a follower 102 which rests on the latch 100 to move downwardly along arrow G to provide clearance so that a frame lip 104 (projecting into the cap from a frame bottom edge) and having a receiver 106 therewith in, can be freed from the follower 102 to allow the display glass and frame 46, 48 to move along arrow E of FIG. 10 and thereafter along arrow D. The latch 100 may be cam locked about its pivot P so that it is at the normal at-rest position of FIG. 9 to provide a positive lock. The follower 102 may be spring driven down by a circumscribing spring 103 so that it only engages the receiver 106 when the latch is in the locked (FIG. 9) position.

The display glass 46 and frame 48 can remain in an upper, non-telescoped position by virtue of a cantilevering force that operates on a portion of the frame 48 near the top. As shown in FIG. 10, a downwardly extending purchase area 108 of cap 40 abuts against a contacting face 110*a* extending the width (long aspect) of the frame 48 and holds it in place there in conjunction with the frame pivot P located on each trackway 90. The pivot P is also constrained to move within the trackway 90 so that it moves from the FIG. 10 position to the FIG. 11 position and is held in secure engagement. Note the contacting face 110*b* of the frame 48 has moved down (i.e. along the shorter aspect) of the frame in FIG. 11.

Figure 12:
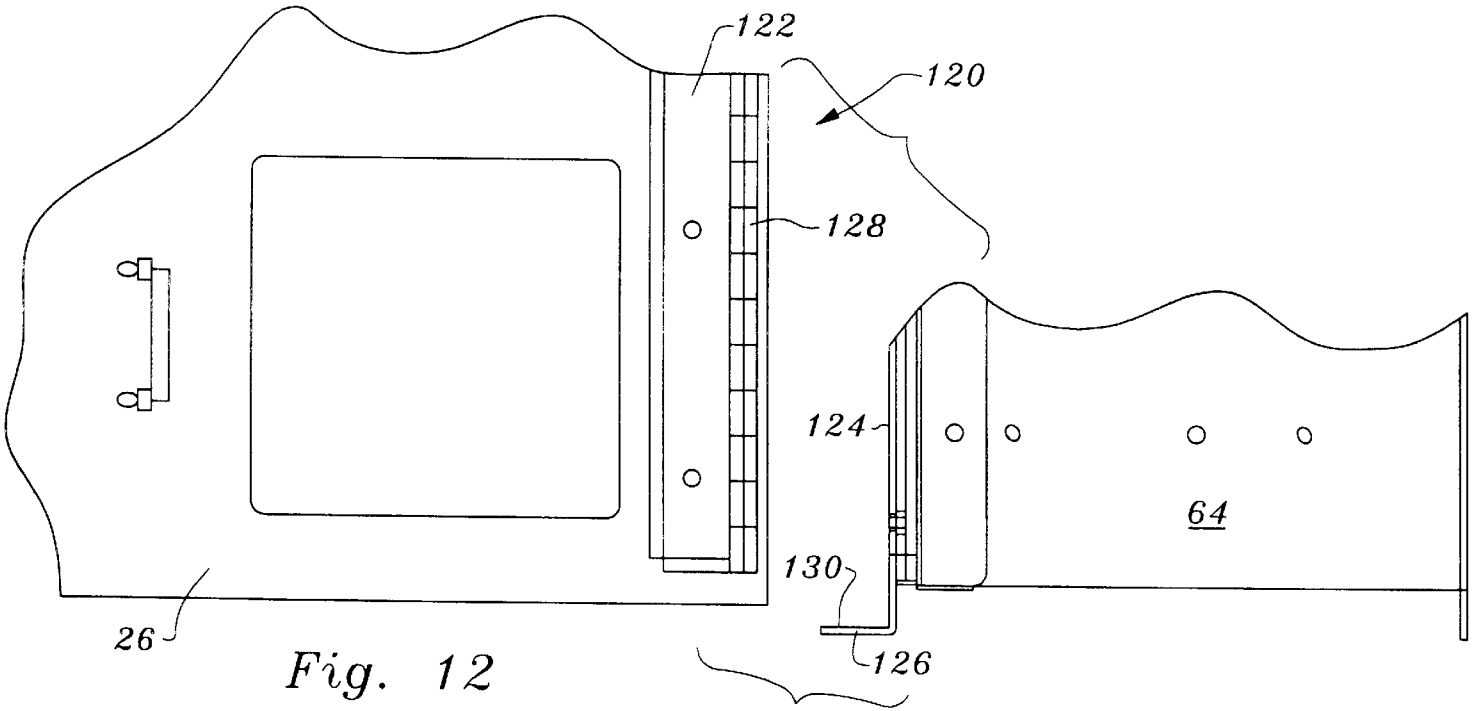
FIG. 12 is a top plan fragmented view of the slant top upper panel and a phantom view of a hinge which supports the slant top upper panel to a main body of the gaming machine.
Figure 13:
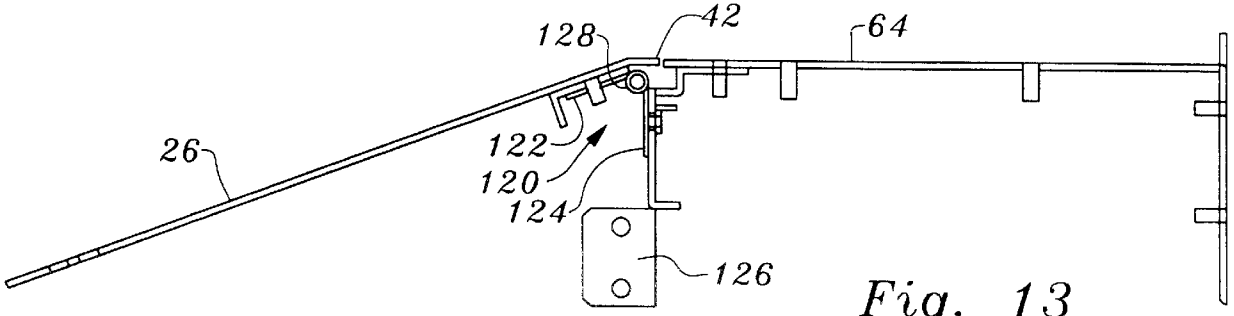
FIG. 13 is a fragmented side view detailing the hinge shown in FIG. 8.
Figure 14:
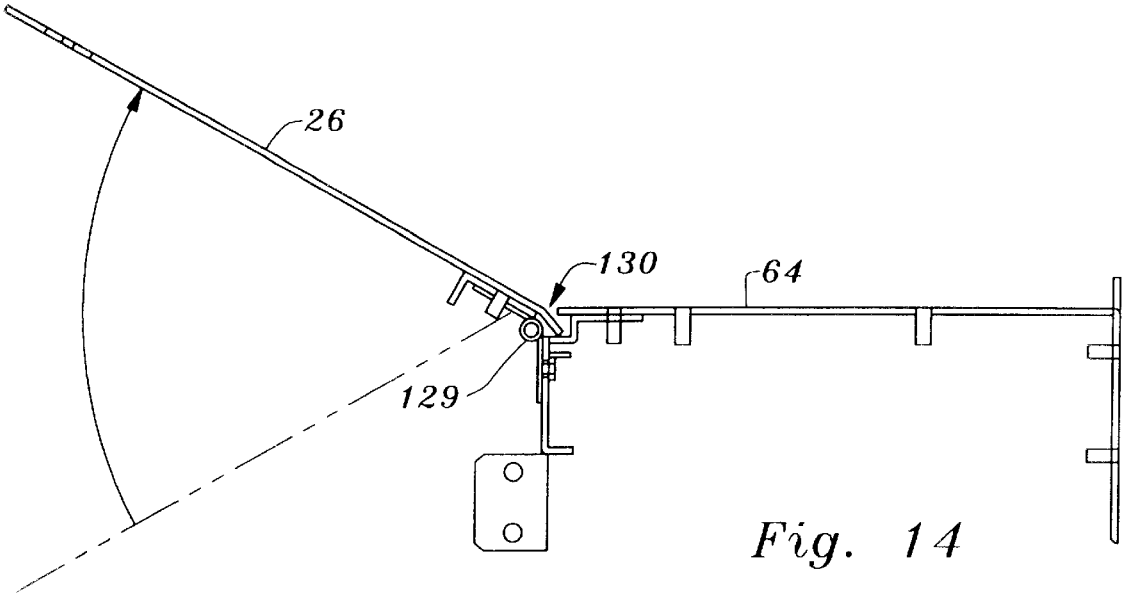
FIG. 14 is a fragmented side plan view of the slant top upper panel in an open, unlatched position.

FIGS. 12 through 14 show details of the hidden hinge 120 that is located adjacent the back edge 42 of the slant top panel 26 and allows articulation about the top surface 64 of the slant top. As shown in FIG. 13, the hidden hinge 120 is not visually discernible to passersby and therefore provides both aesthetic and functional benefits, for example, to prevent tampering. As shown in FIG. 12, the hinge 120 includes a first hinge leaf 122 located on the slant top panel 26 and a second leaf 124 on a vertical lip in front of the top surface 64 of the slant top. In addition, the second leaf 124 includes a pair of tangs 126 at opposite ends of leaf 124 to mount leaf 124 on interior faces of side panels 4. An interleaved pivoting portion 128 connects the two leaves 122, 124 by a rod 129 (FIG. 14). The interleaved pivoting portion 128 pivots within a clearance 130 between slant top panel 26 and top surface 64.

Figure 15:
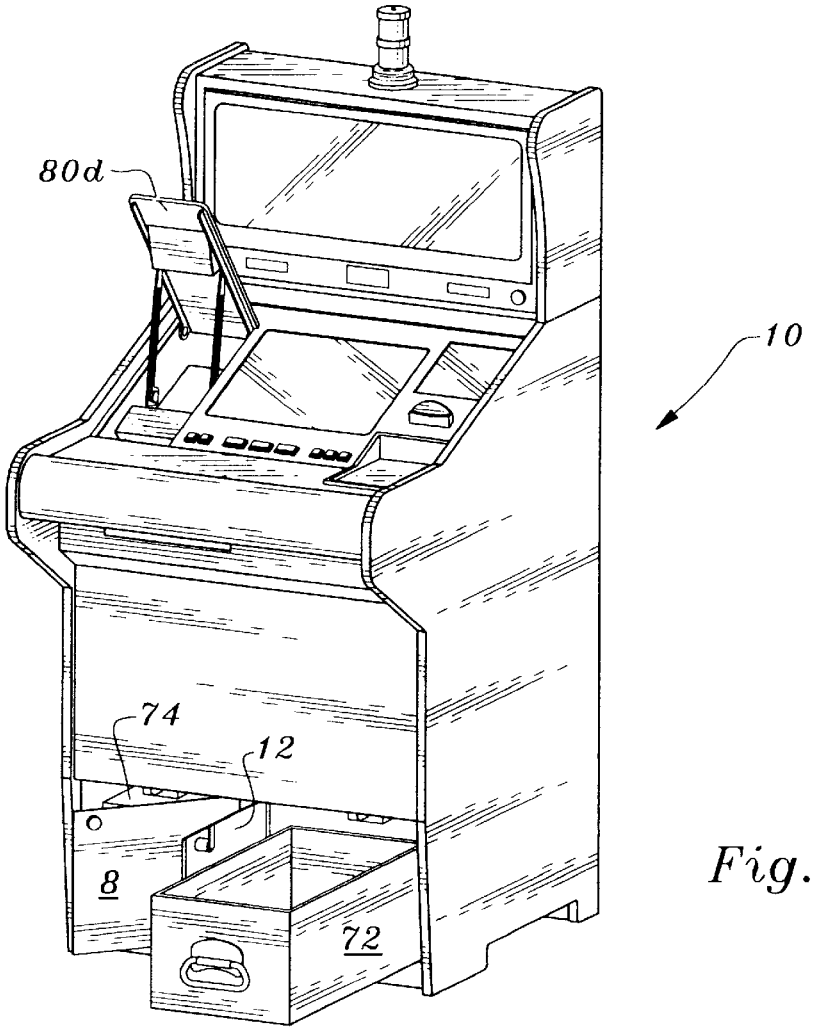
FIG. 15 is an elevational perspective view of the gaming machine according to the present invention showing a bill validator door in an open position and a pair of lower bottom doors in an open position revealing a coin box and a secured electronic box.

FIG. 15 is an elevational perspective view showing both the bill validator door 80*d* in an open position and a pair of lower bottom doors 8, 12 also open revealing the coin box 72 and electronic box 74 secured in the respective areas and isolated from access by persons only having limited rights to certain sections of the device 10.

Figure 17:
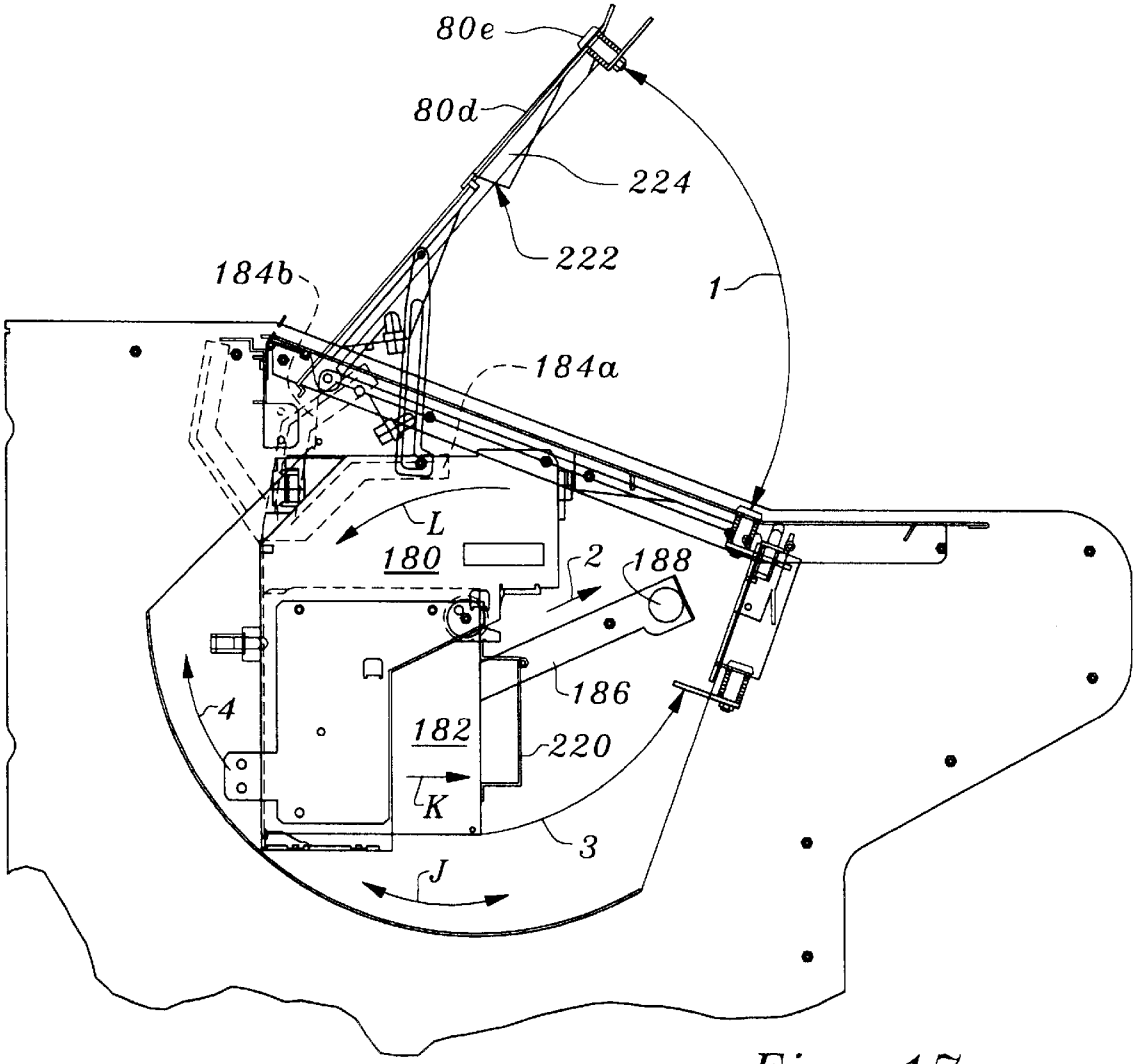
FIG. 17 is a fragmented plan side view of the main body of the gaming device, with portions cut away, to reveal detail of the bill acceptor and showing the top door of the bill acceptor in an opened unlocked position.
Figure 16:
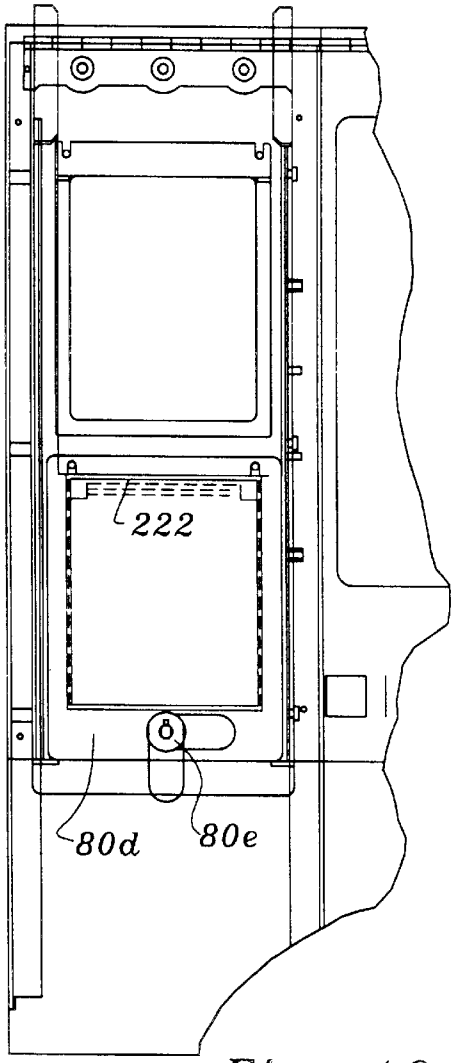
FIG. 16 is a fragmented top plan view of the slant top showing a top plan view of the bill acceptor door and further detail of a bill acceptor in phantom.
Figure 18:
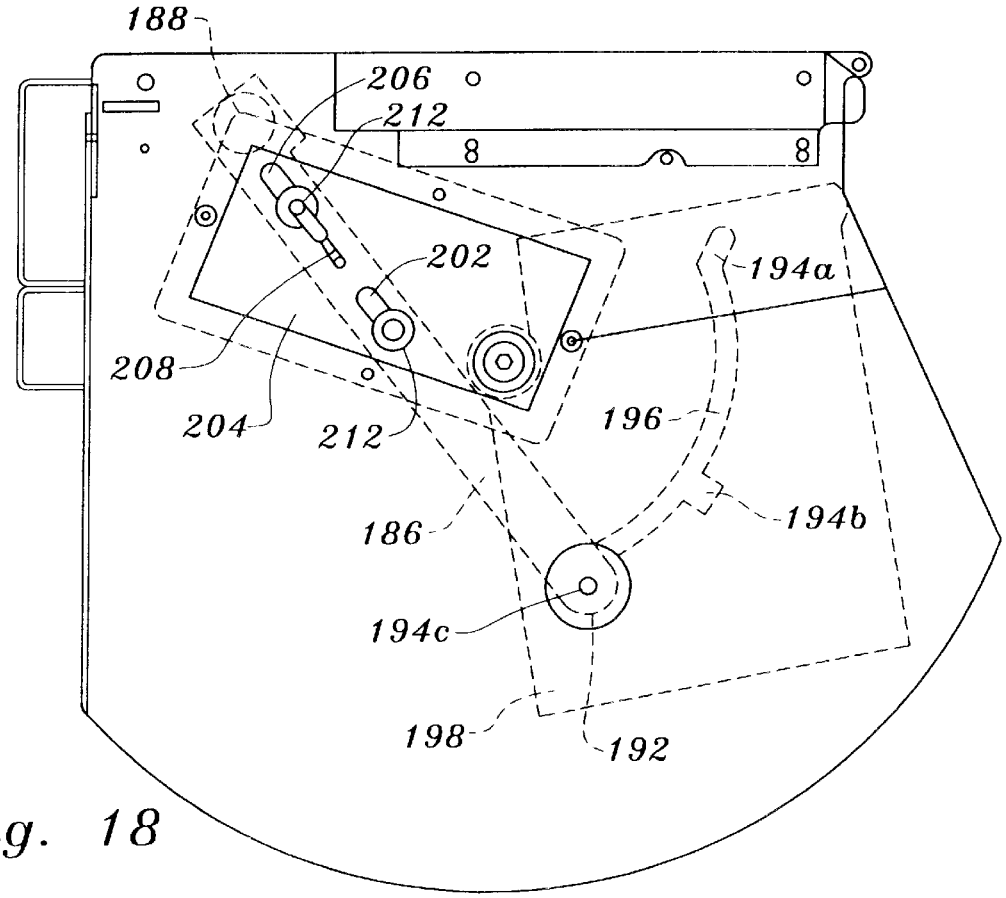
FIG. 18 is a side view of the bill acceptor housing opposite from FIG. 17 and partially in phantom.

With respect to FIGS. 16 through 18, the mechanism for the bill acceptor is generally illustrated. A detailed analysis of the bill acceptor and bill box per se will not be elaborated upon herein, so as to not obscure salient points of the bill acceptor in its relationship to the housing.

The bill validator has three common orientations: a first orientation shown in FIGS. 16 and 17 in which in FIG. 16 it is ready for operation and in FIG. 17 ready for the access. Frame 80*d* has been unlatched at 80*e* in anticipation for manipulation. Manipulation involves rotation of a cage 180 in either direction along the double-ended arrow J of FIG. 17. The FIG. 17 position reflects a normal status position for the bill validator when not being maintained. The bill validator thus moves about the arrows 3 or 4 to respectively provide access to a bill box 182 (arrow 3) or to move the validator (arrow 4) to open a door 184 to clear jam ups when currency gets entrained within the bill processing mechanism. Thus, the bill jam door 184 opens to clear jam ups.

A release lever 186, when pulled along the direction of the arrow 2 permits the bill cage to move about the arrow J. The release lever 186 includes a finger hole 188 to facilitate release. Referring to FIGS. 17 and 18, the cage 180 shown in FIG. 17 will be in the extreme position from having been rotated along the arrow 4 of FIG. 17. Clearance is therefore provided for the bill jam door 184 to be moved into the position of FIG. 18 to free jam ups. The release lever 186 causes a bushing 192 shown in notch 194*c* to be freed from one of three notches 194*a, b, c* in a trackway 196 found on a bill acceptor wrap 198. The bushing 192 can select either of the three notches 194 based on rotation of the cage 180 through the arc 196 of the track. Bushing 192 is located on the release lever 186 at an end opposite the finger pull 188. The release lever is constrained to ride within a first groove 202 formed on a mounting plate 204. A second groove 206 on the plate 204 includes a spring mechanism 208 which urges the lever 186 into any of the notches 194. Rollers 212, in groove 206 (in conjunction with spring 208) and in groove 202 make the lever 186 operation smooth.

A handle 220 (FIG. 17) is operatively coupled to the bill box 182 and allows the bill box to be moved in the direction of the arrow K after the lever 186 has been released from at rest notch 194*b* and the cage 180 is allowed to be moved in the direction of the arrow 3 of FIG. 17 so that the notch 194*a* of FIG. 18 will have been accessed. This allows the bill box 182 to be removed and replaced with an empty one. Bill box 182 is provided with a shutter mechanism as is known in the art to seal the box upon its removal from the cage 180 for emptying in a secure area. As shown in FIGS. 16 and 17, a currency receiving slot 222 receives bills by means of a diverging funnel 224 that directs the money into a mouth of the bill validator. Money received through the currency mouth 222 follows a path generally described as L in FIG. 17 into the bill box 182. Should a jam occur, the jam door 184 is moved from the 184*a* to the 184*b* position after the cage 180 has been moved to the notch 194*c* position shown in FIG. 18 along arrow 4 (FIG. 17).

Figure 19:
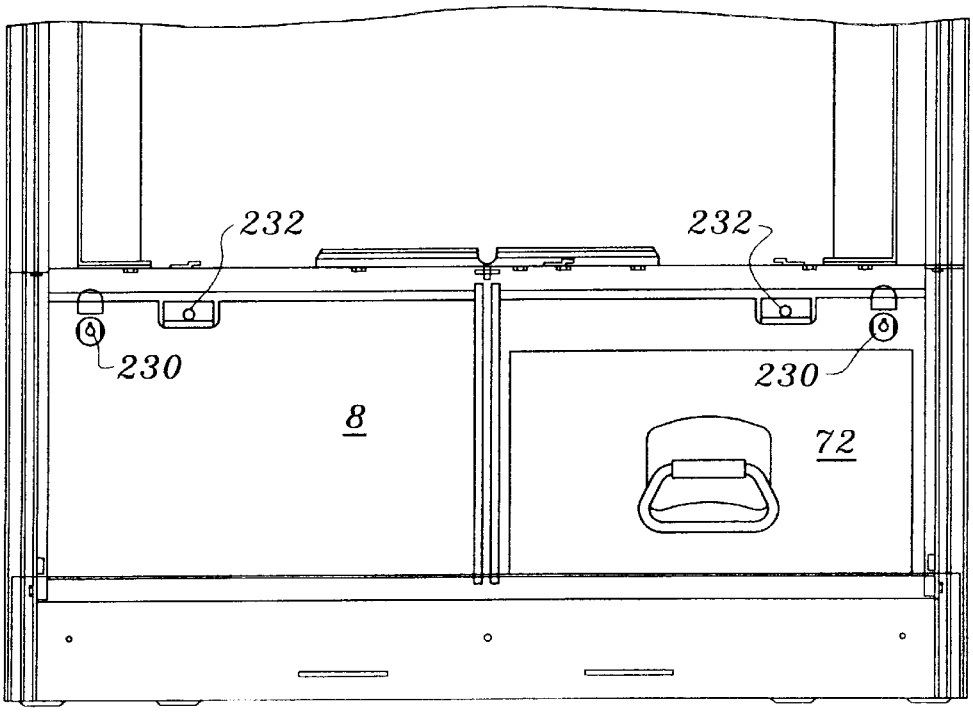
FIG. 19 is a fragmented front plan view of the gaming device showing the pair of lower doors disposed in a bottommost portion thereof.
Figure 20:
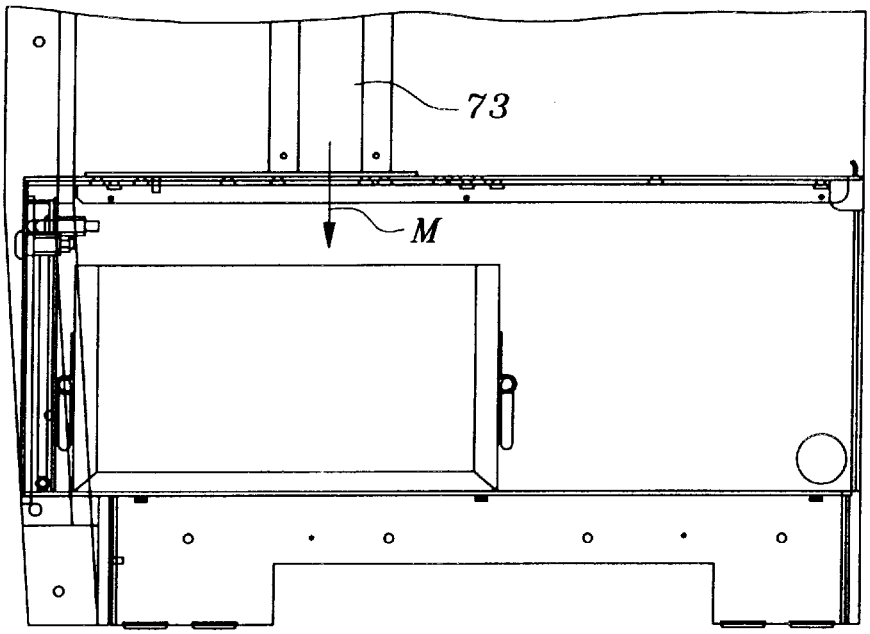
FIG. 20 is a fragmented side view of one side of the main body of the gaming device with portions cut away to reveal detail of a coin box and a lower coin drop door disposed in the lowermost portion of the main body of the gaming device.
Figure 21:
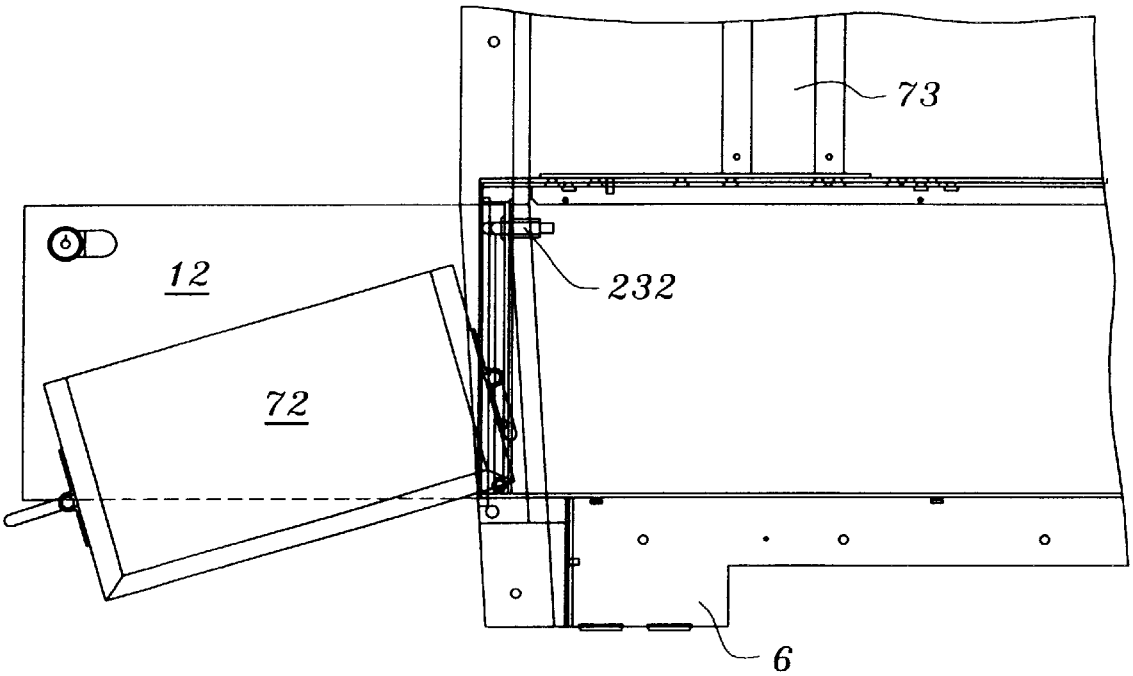
FIG. 21 is a fragmented side view of a lowermost portion of the gaming device showing the lower coin drop door in an open position and the coin box removed from the gaming device.

FIGS. 19 through 21 reflect details of the lower doors 8, 12 and the means by which they can be unlocked and accessed. As shown in FIG. 19, for example, a key operated latch 230 allows access to one of the two doors 8, 12. Push button indicators 232 indicate to remote personnel that the doors have been opened. Once opened, as shown in FIG. 21, the coin box 72 can be replaced. The coins in coin box 72 are received down a chute 73. FIG. 20 reflects the coins dropping through the chute 73 along arrow M.

Having thus described the invention it should be apparent that numerous structural modifications and adaptations may be resorted to without departing from the scope and fair meaning of the instant application as set forth hereinabove and as defined hereinbelow by the claims.

I claim:

1. A gaming cabinet, comprising, in combination:

a base, a housing extending up from said base, a top panel overlying said housing, a cap extending up from said housing rearward of said top panel including a display panel wherein said display panel moves from a vertical plane to a horizontal plane about a pivot, said pivot constrained to ride within a trackway, said trackway allowing telescopic insertion of said display panel into said top cap, said cap having a substantially rectangular hollow contour and including said front display panel adjacent said top panel, said display panel including a circumscribing frame including pivot pins at top lateral extremities, said pins captured in said trackway to move said display panel from a display position to a retracted position in said cap.

2. The gaming cabinet of claim 1 wherein said top panel includes a well depending from a bottom face thereof which isolates a bill receiver from unauthorized access.

3. A gaming cabinet, comprising, in combination:

a base, a housing extending up from said base, a top panel overlying said housing, a cap extending up from said housing rearward of said top panel including a display panel wherein said display panel moves from a vertical plane to a horizontal plane about a pivot, said pivot constrained to ride within a trackway, said trackway allowing telescopic insertion of said display panel into said top cap, said cap having a substantially rectangular hollow contour and including said front display panel adjacent said top panel, said display panel including a circumscribing frame including pivot pins at top lateral extremities, said pins captured in said trackway to move said display panel from a display position to a retracted position in said cap, wherein said top panel includes a well depending from a bottom face thereof which isolates a bill receiver from unauthorized access, and wherein said bill receiver is accessible from a top surface of said panel by means of an openable door, said bill receiver supported in a cage, said cage having means for rotation into three distinct positions: a first normally deployed position, a second position where said cage and bill receiver are rotated to provide clearance for bill jam removal means and a third position allowing a bill box to be removed from said bill cage.

4. The gaming cabinet of claim 3 wherein said cabinet is formed from sheet metal.

5. The gaming cabinet of claim 4 wherein said display panel includes removable fastening means for rapid change over of said display panel.

6. The gaming cabinet of claim 5 wherein a concealed hinge extends between said top panel and an edge of said cap, said hinge being normally inaccessible from passersby.

7. A gaming cabinet, comprising, in combination:

a base, a housing extending up from said base, a cap extending up from said housing rearward of said top panel, a top panel overlying said housing, said top panel having a hinge at an edge remote from a front wall thereof, said hinge concealed from plain view, wherein said top cap is received on a topmost portion of said housing and retained therein by means of cap projections extending within slots on said housing, said top cap including a display panel adapted to move from a vertical plane to a substantially horizontal plane.

8. The gaming cabinet of claim 7 further including first and second doors located on a front wall of said housing, each said door allowing access respectively only to electronics or a coin box.

9. The gaming cabinet of claim 8 in which said door allowing access to said coin box includes a chute extending up from said coin box to receive coins from a coin slot.

10. The gaming cabinet of claim 7 wherein said display panel moves from said vertical plane to said horizontal plane about a pivot, said pivot constrained to ride within a trackway, said trackway allowing telescopic insertion of said display panel into said top cap.

11. The gaming cabinet of claim 10 wherein said display panel moves from said vertical plane to said horizontal plane after unlatching a latching means, said latching means including a follower vertically oriented and adapted to release a receiver formed on a lip of a frame circumscribing said display panel.

12. The gaming cabinet of claim 11 including cantilevering means for holding said display panel out from said top cap after rotation of said panel from a vertical plane to a horizontal plane, said cantilevering means including an area of contact with said top cap in conjunction with said pivot pins.

13. A gaming cabinet, comprising, in combination:

a base, a housing extending up from said base, a cap extending up from said housing rearward of said top panel, a top panel overlying said housing, said top panel having a hinge at an edge remote from a front wall thereof, said hinge concealed from plain view, further including first and second doors located on a front wall of said housing, each said door allowing access respectively only to electronics or a coin box, said door allowing access to said coin box includes a chute extending up from said coin box to receive coins from a coin slot, wherein said top cap is received on a topmost portion of said housing and retained therein by means of cap projections extending within slots on said housing, said top cap including a display panel adapted to move from a vertical plane to a substantially horizontal plane.

14. A gaming cabinet, comprising, in combination:

a base, a sheet metal housing extending up from said base, a cap extending up from said housing rearward of said top panel wherein said top cap is received on a topmost portion of said housing and retained therein by means of cap projections extending within slots on said housing, said top cap including a display panel adapted to move from a vertical plane to a substantially horizontal plane, a top panel overlying said housing, and a front wall of said housing including plural locked portals which, when opened respectively reveal only a coin drop or game electronics hardware.

15. The gaming cabinet of claim 14 wherein said top panel moves from a first deployed position to a second open position thereby allowing access to a monitor disposed within said housing and exposed through said panel.

16. The gaming cabinet of claim 15 wherein a plurality of decision making buttons project through openings in said panel, said buttons becoming accessible along with an associated button box upon opening of said panel to allow removal of the button box or the monitor as modules.

17. The gaming cabinet of claim 16 including a piano-type hinge allowing said top panel to move from an overlying position with respect to said housing to an open position, said piano-type hinge having a first leaf affixed to an underlying edge of said panel, a second leaf oriented on a ledge of said housing, and pivot leaves interconnecting said first leaf and said second leaf through a pivot pin.

18. The gaming cabinet of claim 17 in which a bill receiver is carried within a well depending from a bottom face of said panel, said bill receiver having means for rotation about an axis including a first normally deployed position, a second position allowing jam ups from bills having been received to be freed and a third position allowing a bill box to be removed from the bill receiver.

19. The gaming cabinet of claim 18 wherein said bill receiver includes a release lever which allows motion among said three positions.

20. The gaming cabinet of claim 19 wherein said top cap is affixed to said housing and wherein said display panel moves from said vertical plane to said horizontal plane about a pivot, said pivot constrained to ride within a trackway, said trackway allowing telescopic insertion of said display panel into said top cap.

21. A gaming cabinet, comprising, in combination:

a base, a sheet metal housing extending up from said base, a top panel overlying said housing, and a cap extending up from said housing rearward of said top panel wherein said top cap is received on a topmost portion of said housing and retained therein by means of cap projections extending within slots on said housing, said top cap including a display panel adapted to move from a vertical plane to a substantially horizontal plane.

22. A gaming cabinet, comprising, in combination:

a base, a housing extending up from said base, a top panel overlying said housing, said top panel including a well depending from a bottom face thereof which isolates a bill receiver from unauthorized access wherein said bill receiver is accessible from a top surface of said panel by means of an openable door, said bill receiver supported in a cage, said cage having means for rotation into three distinct positions: a first normally deployed position, a second position where said cage and bill receiver are rotated to provide clearance for bill jam removal means and a third position allowing a bill box to be removed from said bill cage.

* * * * *